United States Patent [19]

Quehen et al.

[11] 4,064,929

[45] Dec. 27, 1977

[54] APPARATUS FOR VARYING THE MOLD LENGTH OF ENDLESS BELT MOLDS USING INTERCHANGEABLE BELTS

[75] Inventors: André Quehen, Pontoise; Roger Figuères, Grenoble, both of France

[73] Assignees: Secim, Courbevoie; Societe de Vente de l'Aluminium Pechiney, Paris, both of France

[21] Appl. No.: 668,797

[22] Filed: Mar. 19, 1976

Related U.S. Application Data

[63] Continuation-in-part of Ser. No. 480,560, June 18, 1974, abandoned.

[30] Foreign Application Priority Data

June 26, 1973 France ..... 73.23326

[51] Int. Cl.[2] ..... B22D 11/06

[52] U.S. Cl. ..... 164/433; 164/87; 425/373

[58] Field of Search ..... 164/87, 278; 425/224, 425/373

[56] References Cited

U.S. PATENT DOCUMENTS

| | | | |
|---|---|---|---|
| 1,612,737 | 12/1926 | Lane | 164/278 |
| 3,735,802 | 5/1973 | Chia et al. | 164/278 |
| 3,774,669 | 11/1973 | Lenaeus et al. | 164/278 |

FOREIGN PATENT DOCUMENTS

| | | | |
|---|---|---|---|
| 6,526 | 5/1970 | Japan | 164/278 |
| 2,271 | 1/1970 | Japan | 164/278 |

*Primary Examiner*—Richard B. Lazarus
*Assistant Examiner*—Gus T. Hampilos
*Attorney, Agent, or Firm*—Cameron, Kerkam, Sutton, Stowell & Stowell

[57] ABSTRACT

An apparatus for producing a rolled product from a continuously cast blank provides a continuous casting in a groove in a wheel which groove is closed over part of its length by a metal ribbon and the length of closed groove is adjustable to obtain, for the product being produced, the optimum characteristics of the blank at emergence from the groove for a given wheel speed.

3 Claims, 4 Drawing Figures

APPARATUS FOR VARYING THE MOLD LENGTH OF ENDLESS BELT MOLDS USING INTERCHANGEABLE BELTS

REFERENCE TO RELATED APPLICATION

This application is a continuation-in-part application of our application Ser. No. 480,560, filed June 18, 1974 which is now abandoned.

BACKGROUND OF THE INVENTION

The present invention provides a device for manufacture of a product rolled continuously from a blank obtained by continuous casting into a grooved wheel.

The invention finds application more especially in the domain of transformation of non-ferrous metals or alloys, for example, for the production of wire in a transformation chain starting from the metal or alloy in the liquid state, cast in a grooved wheel and then rolled continuously.

Chains of continuous manufacture of this kind in accordance with the present concept comprise generally at the input a so-called four-wheel casting device illustrated in FIG. 1 (prior art) of the accompanying drawings which is a schematic elevation of the device. This device is followed by a number of roll stands. The casting device comprises a wheel 2 furnished with a peripheral groove and three return wheels 4, 5 and 7 around which runs a metal ribbon 3 forming an endless loop.

Two of the return wheels 4 and 7 arranged respectively above and below the grooved wheel 2 apply the ribbon partially to wheel 2, thus closing the casting groove over a portion of the circumference of wheel 2.

A third return wheel 5 is displaceable slightly by a jack 8 and ensures the tension of the ribbon, the linear speed of which in operation is equal to the circumferential speed of the casting wheel 2. There is thus contact without sliding of the ribbon against wheel 2. In the course of casting, the wheel 2 and the ribbon 3 are cooled forcibly by water. During manufacture of the product a casting nozzle 1, located above the wheel 2, pours molten metal or alloy continuously into the portion of groove closed by the ribbon, where it solidifies into a first blank which is moved directly into the rolling mills of the continuously working chain.

The temperature of the blank where it leaves the wheel is a very important factor to the quality obtained. If it is too high the blank may not be completely solidified and will not withstand the strains to which it is subjected on leaving the grooves. If, on the contrary, the temperature of the blank is too low metallurgical difficulties will appear in the rolling operations and the power necessary for rolling will increase considerably.

It is therefore important to be able to adjust this temperature to an optimum value which depends upon the metal or alloy being worked. Cooling of the metal is effected in the groove by thermal exchange from contact with the rim of the wheel which in turn is generally cooled by spraying with water. As the spraying is already being done with a strong flow it is not practically possible to act any further upon this flow in order to regulate the output temperature of the blank and in known installations the only action possible for modifying this temperature is to act upon the time of dwell of the metal in the groove, that is to say, to act upon the speed of rotation of the wheel. Any increase in speed translates into increase in temperature of the blank and vice versa.

But for a certain product, depending upon the nature of the metal or the alloy, the speed of production of the blank and of flow into the rolling stands downstream cannot vary in significant proportions. Excessive speed would lead to flaws in the cast and rolling defects while a low speed would reduce the industrial output of the installation. In other words, with every product there corresponds a relatively narrow field of temperature and speed leading to optimum manufacturing conditions. In known devices in which adjustment of temperature can only be effected by adjustment of speed it will not therefore be possible to obtain at the same time optimum temperature and speed and it would be necessary for that purpose to arrange a production chain strictly adapted to each kind of alloy.

The present invention has for its object an improvement in such a chain of production and more particularly to improvement of the continuous casting wheel, this improvement permitting use of the same chain of production for alloys of different compositions while providing in all cases optimum conditions of temperature and of speed of lamination.

SUMMARY OF THE INVENTION

In accordance with the present invention, the improved machines for the continuous casting of a metallic ribbon comprises:

a grooved wheel carried by a shaft on fixed bearings with means for rotating the wheel, a motor wheel for an endless metallic ribbon partially surrounding the grooved wheel, the motor wheel being substantially tangent to the grooved wheel and carried by a shaft on fixed bearings including means for rotation at the same peripheral speed as that of the grooved wheel, a first guide and tensioning wheel for the ribbon mounted on moveable bearings with means for movement of the moveable bearings in a direction to apply the ribbon against the periphery of the grooved wheel, a second guide wheel for the ribbon carried by bearings arranged at the extremity of arms pivoting around the axis of rotation of the grooved wheel, the distance between the two wheels being practically equal to the sum of their radii in such a way that the second guide wheel always remains practically tangent to the grooved wheel, means for pivoting the arms articulated around the axis of the grooved wheel and for securing them in a given position between two extreme positions forming between them an angle at least equal to 90°, a set of a plurality of endless ribbons of different lengths each length corresponding to a determined angular position of the pivoting arms, means for pouring a liquid metal at the entry of the part of the groove closed by the ribbon in the zone where the motor wheel for the ribbon is substantially in contact with the grooved wheel, means for cooling the periphery of the grooved wheel and, means for guiding the solidified blank in the zone where it leaves the groove and where the second guide wheel is substantially in contact with the grooved wheel.

REFERENCE TO THE DRAWINGS

The invention will now be described in greater detail by referring to preferred embodiments described by way of non-restrictive examples and illustrated by the figures in the accompanying drawings where:

DESCRIPTION OF THE PREFERRED EMBODIMENT

Figure 1:
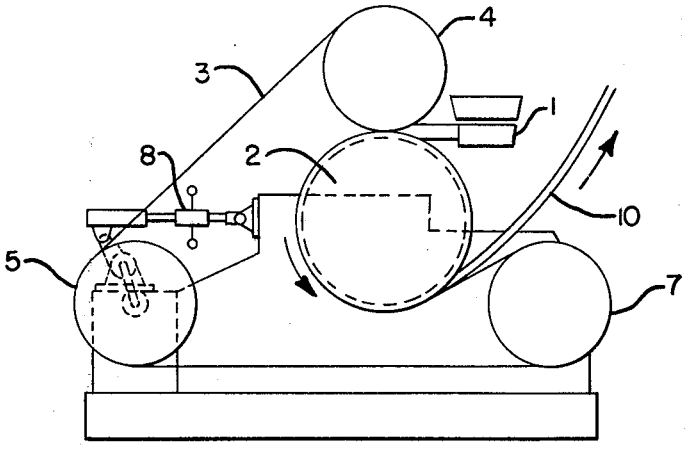
FIG. 1. (PRIOR ART)
FIG. 1 represents the basic prior art apparatus.
Figure 2:
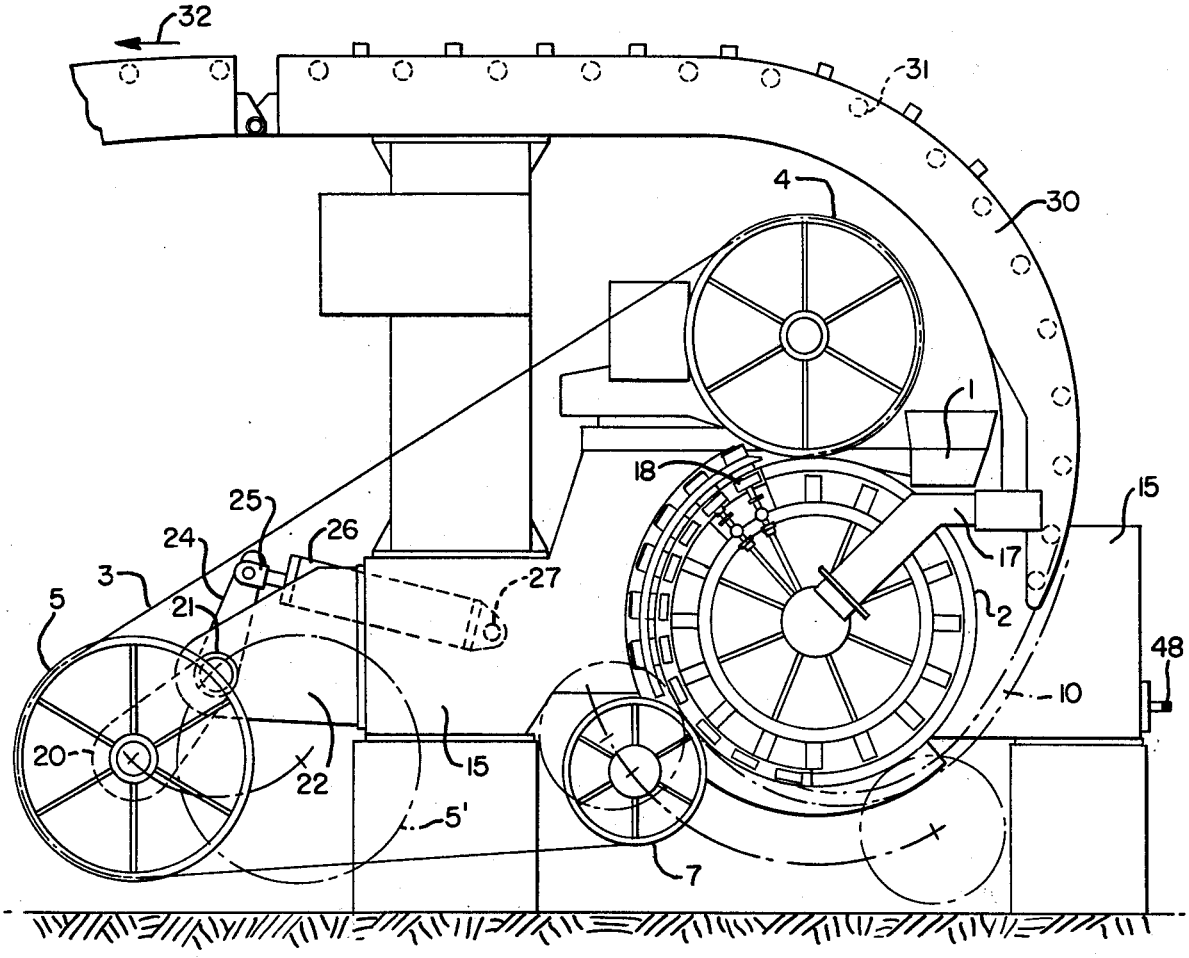
FIG. 2 is an assembly view of a continuous casting machine in accordance with the present invention.
Figure 3:
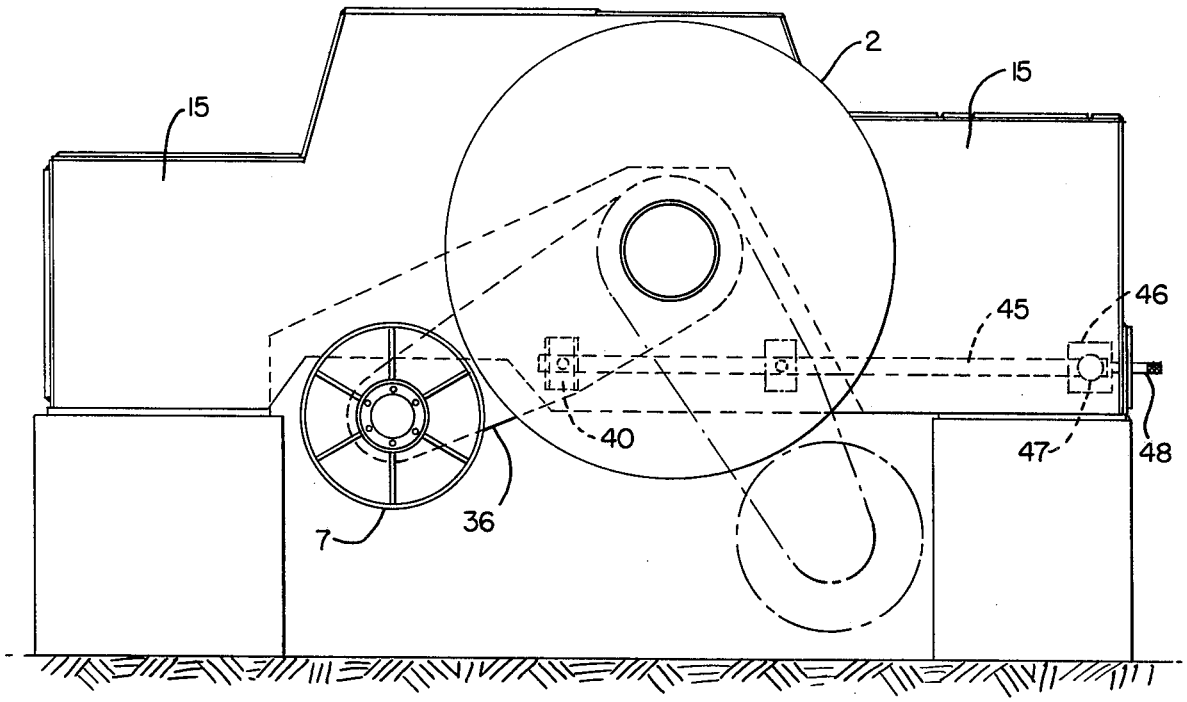
FIG. 3 is a more detailed view of the mechanism for adjusting the position of the support arms for the second guide wheel.
Figure 4:
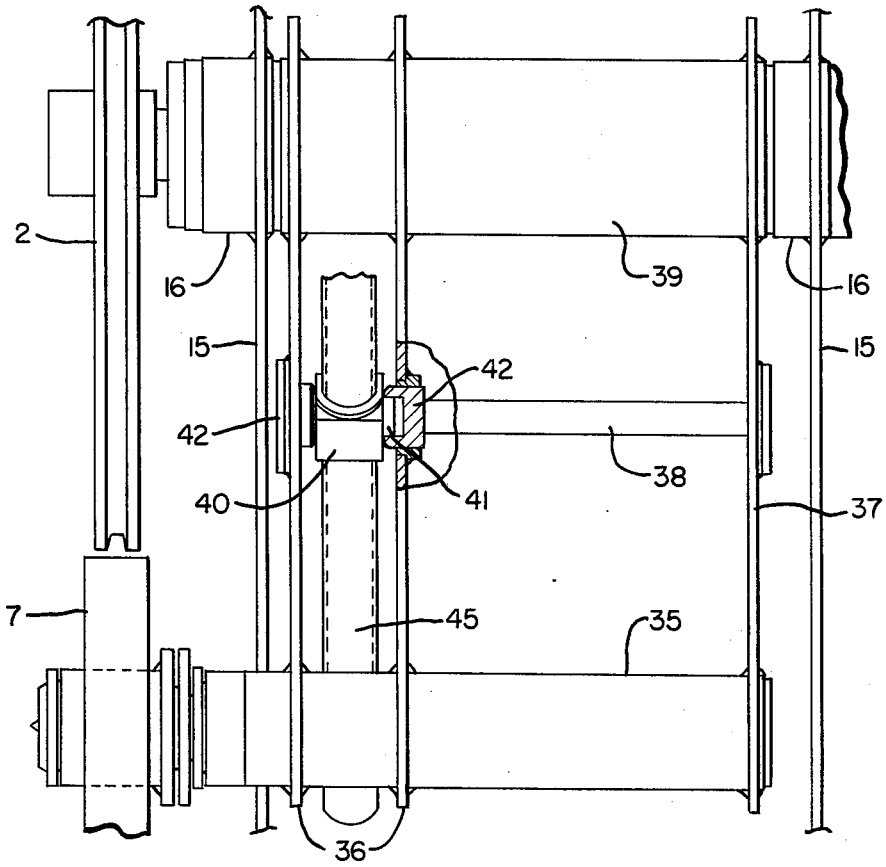
FIG. 4 is a view along the line IV—IV of FIG. 3.

Referring now to FIGS. 2–4, the basic elements of the casting wheel represented in FIG. 1 are shown and similar elements bear the same reference numerals.

The continuous casting machine comprises a base 15 which supports bearings 16 of the grooved casting wheel 2 as well as bearings for the motor wheel 4 for driving the ribbon. The drawings do not show the driving mechanisms for wheels 2 and 4 which are well known and are the same as are found in machines of this general type. The two wheels rotate at the same peripheral speed which is the linear speed of ribbon 3.

Base 15 also supports pouring spout 1 for feed of liquid metal and pipe 17 for the cooling water which is then distributed over the periphery of grooved wheel 2 by ducts 18.

First guide wheel 5, for applying tension to ribbon 3, is mounted at the ends of levers 20 articulated at 21 on an extension 22 of base 15. Levers 20 are connected with another lever 24. The end of lever 24 is articulated by fork 25 to the shaft of a hydraulic jack 26, the cylinder of which is articulated at 27 on base 15. Actuation of jack 26 provides angular displacement of wheel 5 between the extreme positions represented at 5 in full line and at 5' in broken line in FIG. 2, the distance between these two positions being greater than that which would be necessary to provide simple tension for compensation of variations of length due to elasticity and thermal extension of ribbon 3.

The second guide wheel 7 defines the downstream point of the part of the groove closed by the ribbon and consequently the point where solidified blank 10 begins to leave the groove of the casting wheel 2. Blank 10, solid but still hot, is directed toward a guiding chute 30 where it rests on rollers 31 and is directed toward the continuous laminator in the direction of the arrow 32. Wheel 7 is cantelever mounted for free rotation at the extremity of an axle 35 which axle is mounted at the extremities of three parallel arms 36 and 37. One of the arms 36 and arm 37 are connected by a tubular intermediate member 38. The three arms 36 and 37 are articulated by bearings 39 on the same axis as grooved wheel 2.

A threaded nut 40 rotates freely between the two arms 36 on trunions 41 which engage in support 42. Screw shaft 45 engages in nut 40 and is free to rotate but is blocked axially in a support 46 which in turn freely articulates in journals 47 on base 15. The extremity 48 of shaft 45 extends beyond base 15 and includes a portion to receive a hand wheel or other means for rotating it. It is clearly seen that rotation of screw shaft 45 causes the relative displacement of nut 40 and varies the angular position of arms 36 and 37 and of wheel 7 between the extreme positions represented repsectively by full line and by broken line in FIG. 3. The irreversability of the screw and nut system provides for locking of arms 36 and 37 and of wheel 7 in any position between the two extreme positions.

The novel machine thus described provides for very large variation of the engagement of ribbon 3 on casting wheel 2 with the variation here made possible reaching 90°. It follows that it is easy each time a different alloy is used to regulate independently the speed of the wheel and of the ribbon so that the exit speed of blank 10 is the best speed for input into the laminator and the length of the arc of engagement of ribbon 3 and wheel 2, that is, the position of arms 36 and 37, is such that the exit temperature of the blank provides the best input temperature at the laminator which temperature depends entirely on the composition of the alloy.

After an adjustment for each alloy composition, it will suffice to repeat the angular position of arms 36 with respect to base 15 for each time the same alloy is employed and the assembly of pouring wheel and laminator can be immediately brought to optimum speed and wheel 2 to the optimum length of closed groove.

For each position thus determined for arms 36 and 37, corresponding to each alloy usually cast, there will correspond a predetermined length of ribbon 3. The improved machine of the present invention will therefore include a set or plurality of endless ribbons 3 of different lenghts, in principle, one for each position of the arms. Actually, the number of ribbons can be limited by utilizing the compensation for length furnished by displacement of tension wheel 5 which has a movement greater than that actually necessary for adjustment of tension. Thus the same ribbon could cover all of a partial range of angular positions corresponding to several different alloys. Practically, three or four lenghts of ribbon 3 could thus cover all of the angular range of 90°.

Advantages of the new machine will be best understood by referring to a conventional high-output manufacturing chain designed for pure aluminum products with continuous casting in a grooved wheel followed by a rolling train. This installation includes a casting wheel of 1400 mm diameter with a groove of 1000 $mm^2$ in section. For the basic production of pure aluminum products the groove is closed by a ribbon over a length of 2500 mm; with a linear speed of 11.5 m/min. The temperature of the continuous blank is the optimum temperature of 450° C at the input to the first rolling stand. The power consumed is then 60 to 70 KW.

It has been tried to employ this conventional installation also for working an alloy known as 5052 with a base of aluminum and containing in addition 2.5% of Mg and 0.20% of Cr. Being unable to change the closed length of the groove, the following results were obtained:

a. At a speed of 9.5 m/mn the temperature of the blank at the input to the rolling mill was only 370° C and the power consumed because of the excessive hardness of the blank reached 140 KW.

b. In order to obtain a satisfactory temperature of 450° C it was necessary to raise the speed to 13.5 m/mn and the power consumed reached 150 KW. The reduction in force required at the rolling mill was in this case largely compensated by the increase in its speed.

It can be seen that in these two cases the installation had to work outside of its normal field of power.

On the other hand, with the machine as described above, it is possible to obtain a 9.5 m/mn, by reducing the closed length of the groove to 1650 mm. The power consumed was then 90 KW. On the same conventional machine an attempt was made to work an alloy known as 5056 with a base of aluminum and containing 5% of Mg. 0.10% of Mn. For this alloy the optimum range of temperature of the blank lies between 400° and 420° C for avoiding rolling defects, while the rolling speed should lie between 9 and 10 m/min. With a closed groove length of 2500 mm it is impossible to have both the optimum range of temperature and of speed. Thus for a speed of 10 m/mn the temperature of the blank reaches only 310° C.

On the other hand, with the machine described above, when varying the covered length of the groove, it was possible to reach a blank temperature of 410° C at a speed of 10 m/mn, the length of wrap of the ribbon having in that case been reduced to 1650 mm.

It will be appreciated that the present machine is able to work under optimal conditions 5056 and 5052 alloys as well as pure aluminum. Such an improved machine will save expensive investments in an aluminum transforming plant where the expected production of each kind of alloy would not justify a casting-rolling line for each alloy.

Of course, the scope of the present invention is not limited to the embodiments which have been described above by way of non-restrictive examples and the present invention also covers any variants which would differ only in detail or in the employment of equivalent means.

We claim:

1. Improved machine for the continuous casting of a metallic ribbon comprising a grooved wheel, a base, bearings on said base supporting said grooved wheel, means for rotating said grooved wheel, a motor wheel, a first endless metallic ribbon on said motor wheel and partially surrounding said grooved wheel to form a mold, said motor wheel being substantially tangent to said grooved wheel, bearings mounted on said base for mounting said motor wheel relative to said grooved wheel, means operatively assoicated with said motor wheel for rotating said motor wheel at the same peripheral speed as said grooved wheel, a first guide wheel operatively assoicated with said endless metallic ribbon for tensioning said ribbon, movable bearings for moving said first guide wheel mounted on said base, means operatively associated with said movable bearings for moving said movable bearings in a direction tending to apply said ribbon against the periphery of said grooved wheel at a specific tension, a second guide wheel operatively associated with said ribbon, bearings mounting said second guide wheel, arm means supporting said bearings mounting said second guide wheel and pivoting around the axis of rotation of said grooved wheel, the distance between the centers of said two guide wheels being practically equal to the sum of their radii such that said second guide wheel remains substantially tangent to said grooved wheel, means for pivoting said arms articulated around the axis of said grooved wheel and for fixing them in a given position between two extreme positions, said extreme positions forming between them an angle of at least 90°, a plurality of endless metallic ribbons of different lengths from said first endless metallic ribbon and interchangable therewith each corresponding to a different predetermined angular position of said pivoting arms to form molds of different lengths, means operatively associated with the grooved wheel and endless metallic ribbon for pouring liquid metal at the entry of the part of the groove closed by said ribbon in the zone where said motor wheel of the ribbon is substantially in contact with said grooved wheel, means operatively associated with said grooved wheel for cooling the periphery of said grooved wheel, and means operatively associated with said grooved wheel and second guide wheel for guiding the solidified metal blank from the zone where it leaves the groove and where said second guide wheel is substantially in contact with said grooved wheel.

2. A machine as described in claim 1, said means for pivoting said articulated arms including a nut articulated on said arms, an adjusting screw engaged in said nut for free rotation and blocked against axial displacement in a support articulated on said base and means for rotating said adjusting screw.

3. A machine as described in claim 1 in which the displacement of the moveable bearings of said first guide wheel for tensioning said ribbon is greater than that necessary for adjustment of tension of said ribbon, thus reducing the number required of endless ribbons of different lengths, each ribbon corresponding to a partial range of angular positions between the extreme positions of said pivoting arms.

* * * * *